United States Patent [19]

Pauwels et al.

[11] Patent Number: 4,625,768

[45] Date of Patent: Dec. 2, 1986

[54] BATTEN FOR WEAVING LOOM

[75] Inventors: Bernard J. Pauwels, Roeselare; Paul J. Huyghe, Jabbeke; Ignace F. Meyns, Ichtegem, all of Belgium

[73] Assignee: N.V. Weefautomaten Picanol, Ypres, Belgium

[21] Appl. No.: 707,377

[22] Filed: Mar. 1, 1985

[30] Foreign Application Priority Data

Mar. 2, 1984 [BE] Belgium ..... 2/60357
Feb. 19, 1985 [BE] Belgium ..... 2/60618

[51] Int. Cl.[4] ..... D03D 49/60
[52] U.S. Cl. ..... 139/188 R; 139/190
[58] Field of Search ..... 139/188 R, 190, 191

[56] References Cited

U.S. PATENT DOCUMENTS 3,882,902 5/1975 Freisler et al. ..... 139/190
4,076,048 2/1978 Bolleter et al. ..... 139/190

FOREIGN PATENT DOCUMENTS 2026845 2/1971 Fed. Rep. of Germany ..... 139/191
2528765 12/1976 Fed. Rep. of Germany ..... 139/190
591536 2/1978 U.S.S.R. ..... 139/190
739145 6/1980 U.S.S.R. ..... 139/190

*Primary Examiner*—Henry S. Jaudon
*Attorney, Agent, or Firm*—Bacon & Thomas

[57] ABSTRACT

A batten for a massive or weaving loom of the kind composed of a solid batten shaft on bearings, on which shaft batten components like batten legs, a batten beam and a reed are fastened, characterized by the fact that the batten is located in such a way that its swinging axis (O—O) is parallel with the central axis (A—A) of the batten shaft (1) and with the axis of gravity (Z—Z) of the system composed of the batten shaft (1) and of the batten components (2, 3, 4) fastened on it, whereby the swinging axis (O—O) and the axis of gravity (Z—Z) are located outside the center axis of the shaft (A—A), but within the periphery of the batten shaft (1).

9 Claims, 5 Drawing Figures

Fig. 1
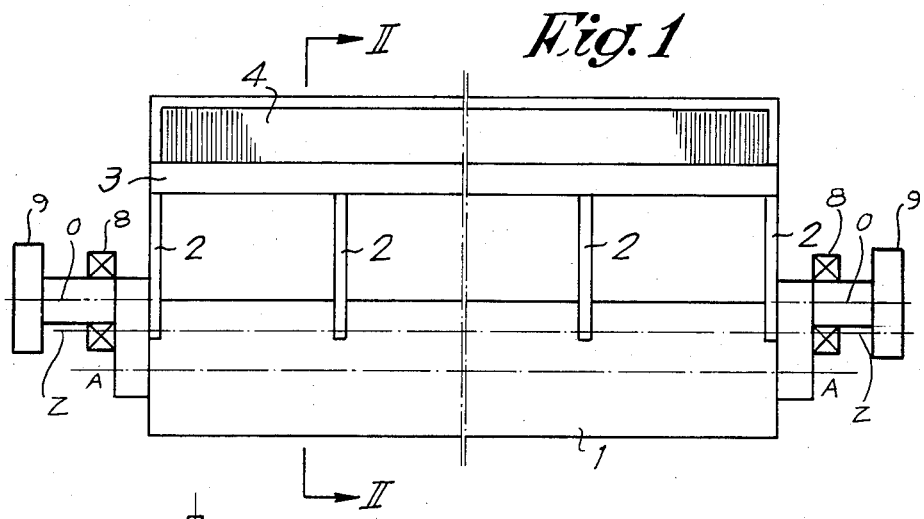
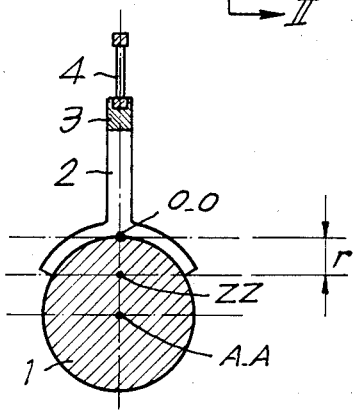
Fig. 2
Fig. 4
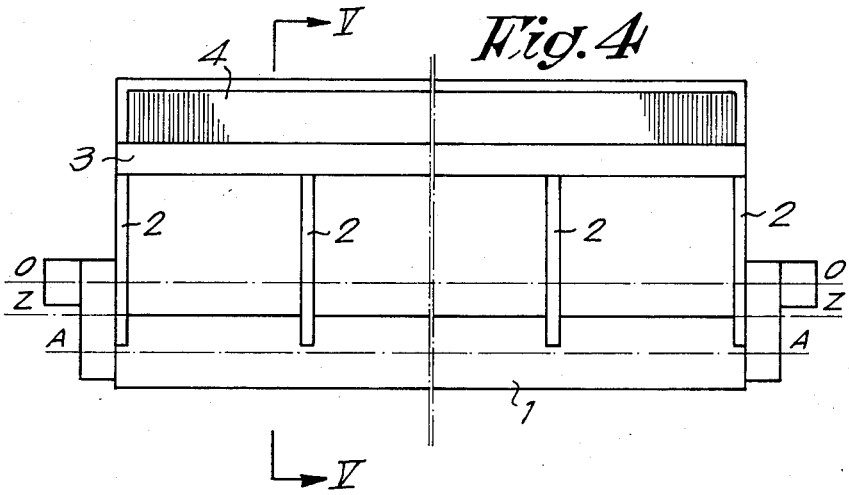

BATTEN FOR WEAVING LOOM

BACKGROUND OF THE INVENTION

1. Field of the Invention

The invention concerns a batten for looms.

2. Description of Related Art

More particularly, the invention is concerned with a batten which is equipped with, besides the batten legs, the batten beam and the reed, of a batten shaft which is designed as a counterweight.

More specifically, the invention concerns a batten wherein the center or axis of gravity of the batten (including possibly the counterweight) does not coincide with the swinging axis of the batten but is located at a defined distance underneath the swinging axis and/or the opposite side of the reed in relation with this axis.

In a preferred form, the batten according to the invention is designed in such a way that, besides the above recited characteristics, it has a minimum moment of inertia in relation to its center of gravity or axis of gravity.

Prior art looms are generally equipped with a batten composed of a batten shaft in a horizontal position, whereon batten legs, reed beams and the reed are mounted. Consequently, the center of gravity does not lie on or coincide with the swinging axis and the center of gravity is always located at the side of the reed in relation with the swinging axis in such a way that the center of gravity is generally located above the swinging axis.

It has also been suggested in the prior art to equip the batten with counterweights according to are general principles of balancing techniques which are based on the dynamics theory and according to which the counterweights are fitted on a swinging body in such a way that the center of gravity of the whole system is located on the swinging axis.

Another prior art solution comprises displacing the batten axis a quite large distance in relation to the swinging axis by the use of check flanges. This design is advantageous in the sense that the total batten weight remains approximately the same whereby the displaced batten axis plays the part of a counterweight and the batten legs generally have a hollow structure in order that the total weight of this balanced batten is not larger than the weight of an unbalanced batten. This embodiment is known for instance from the U.S. Pat. No. 4,075,048.

Although this well known design has the advantageous property of increasing slightly or not at all the total weight of the batten, it offers, however, the drawback of strongly increasing the batten moment of inertia about the swinging axis. It is well known indeed that the inertia of an object swinging around its center of gravity increases when its swinging axis is displaced, on one hand, proportionally with its mass and, on the other hand, proportionally to the square of the displacement distance. If thus the batten axis is displaced, an important and undesirable increase of the inertia moment of the batten occurs, as is already well known, even if the mass is not increased. This well known solution already mentioned has consequently the disadvantage of greatly increasing the driving torque for the batten.

Another system known in the prior art, the batten axis is designed in a special way and is mainly made of a solid cylindrical shaft which is eccentrically located, whereby the center of gravity of the whole batten remains located within or on the geometrical periphery of the batten shaft. The objective of this solution was not to keep the same mass value, but to get a minimum inertia moment around the swinging axis. In a specific embodiment, the axis of gravity and the swinging axis are in coincidence with the geometrical periphery of the batten shaft.

In the latter case, as well in the previous case mentioned above, whereby a total balancing is carried out, it has been stated that nearly no horizontal dynamic forces are applied to the machine. However, the dynamic vertical forces which act on the floor under the loom are quite large and sometimes not acceptable. In weaving factories, where the looms are located on floors above ground level, for instance in an old factory building, these conditions may be quite dangerous to the building stability.

Further research resulted however in the discovery that a more balanced effect of the forces acting on the batten for reacted thereby could be achieved by arranging the center of gravity of the batten under the swinging axis. This design will be described hereafter and illustrated by a few alternative solutions. More specially the force distribution at the supporting points of the loom will be described.

SUMMARY OF THE INVENTION

The improvement according to the invention is based on the design of a batten whereby the distance between its swinging axis its the center of gravity is chosen in such a way that the vertical forces acting on the supporting points of the loom which result from the swinging movement of the batten are eliminated while only horizontal forces are left.

In an alternative solution acording to the invention, a batten is provided wherein the distance between its swinging axis and its center of gravity is chosen in such a way that a compromise solution is achieved between the values of the forces in a horizontal direction, on the one hand, and the vertical forces on the other hand which are acting on the loom supporting points. This solution is advantageous for the reason that, on the one hand, the forces in horizontal direction are smaller than with an unbalanced batten and, on the other hand, the vertical forces are smaller than in a case of a completely balanced batten. Obviously, this discussion is only concerned with the forces which are involved in the movements of the batten.

BRIEF DESCRIPTION OF THE DRAWINGS

In order to give a better understanding of the essential characteristics of the invention, a few preferred embodiments are discussed hereafter as examples only and without any limitation, reference being made to the drawings which are briefly described below.

FIG. 1 shows a front view of a batten according to a preferred embodiment of the invention;

FIG. 2 shows a cross section taken along line II—II of FIG. 1;

FIG. 4 shows a front view of an alternative embodiment of the invention.

DESCRIPTION OF THE PREFERRED EMBODIMENTS

Figure 3:
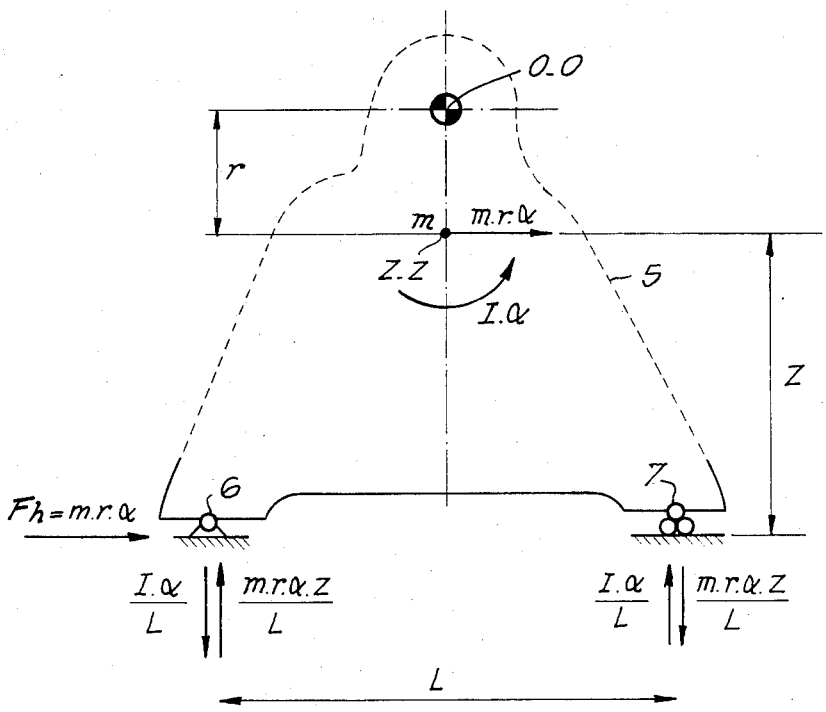
FIG. 3 shows the force distribution pattern of the most prevalent forces occurring in a loom in which the center of gravity of the batten is located under the swinging axis.

FIGS. 1 and 2 illustrate a batten mainly composed of a (i.e., massive) solid cylindrical batten shaft 1 and of a given number of batten legs 2 fastened on it and which support a batten beam 3. The batten legs 2 and the batten beam 3 form the reed supports for a reed 4. The batten is supported by bearings 8 and put into motion by one or two drive elements 9.

Lines A—A, 0—0 and Z—Z respectively correspond to the center axis of the batten shaft 1 (the axis extending through the center of the section of the batten shaft 1), the batten swinging axis and the center or axis of gravity of the batten (all three axes are located parallel to each other). According to the invention, the center or axis of gravity Z—Z is located under the swinging axis 0—0. The advantageous effect resulting from this design is explained hereafter with reference to FIG. 3. The explanation below will also enable the reader to realize the importance of the distance r between the swinging axis 0—0 and the axis of gravity Z—Z.

FIG. 3 is a schematic illustration of a weaving loom 5 which is mounted on support points 6 and 7. For the sake of simplicity, the discussions hereafter as well as the corresonding figure, are based on the most typical and simplified model wherein the batten is represented by a point-like effective mass m which is located at the above-mentioned distance r from the swinging axis 0—0 and having inertia around its center of gravity. For the same reason, the point-like mass m is illustrated in its lowest position, in such a way that the instantaneous acceleration resulting from its rotational acceleration around axis 0—0 (equal to $r.\alpha$) is working in a horizontal direction.

It is obvious that, when the point-like mass m is located in its lowest position, the swinging axis 0—0, the axis of gravity Z—Z and the central axis A—A are located in a vertical plane, whereby the moment I. Resulting from the rotation acceleration $\alpha$ is compensated for by the moment of the forces resulting from the horizontally directed component of the translation acceleration $m.R.\alpha.Z$ in such a way that both moments mutually cancel each other.

The most significant dynamic forces which appear in a batten with reciprocal movement of this kind and which act on the support points 6 and 7 are:

the horizontally directed force resulting from the translation acceleration $m.r.\alpha$;

the moment resulting from the rotation acceleration $I.\alpha$ whereby I represents the inertia moment of the batten in relation to the axis of gravity Z—Z.

These values result from the general theory of mechanics, telling us that the forces acting on moving body may be considered as equivalent to the combination of, on the one hand, the force which is acting on the center of gravity of a body and, on the other hand, of a moment in relationship with this center of gravity.

From the above-mentioned moment as well as from the above-mentioned force, it is quite easy to calculate, according to known methods, the forces acting on the supporing points. These values are thus illustrated as such in FIG. 3 and mainly comprise a horizontally directed force:

$$F_h = m \cdot r \cdot \alpha$$

and a vertically directed force $F_V$ acting in opposite direction on each support point 6–7;

$$F_V = I \cdot \alpha / L - m \cdot r \cdot \alpha \cdot Z / L$$

In this case, the values L an Z are respectively correspond to the distance between the two support points 6 and 7 and to the height of the mass m above the latter.

From the above discussion, it can be realized that the forces $F_V$ are composed of two components acting in opposite directions, whereby the first one results from the above-mentioned moment $I.\alpha$ and the second one results from the mement m in relation to the support points 6–7.

The invention also contemplates an embodiment which is completely different from the conventional balanced batten and in which one strives to minimize the vertically directed forces $F_V$ and to cancel them preferably, this result being achieved by designing the batten mentioned so that the axis of gravity Z—Z is located between the swinging axis 0—0 and the central axis A—A.

In a first embodiment, the distance r between the swinging axis 0—0 and the axis of gravity Z—Z is chosen in such a way that the absolute values of both components of each of the forces $F_V$, namely $I.\alpha/L$ and $m.r.\alpha.Z/L$ are equal.

Owing to the fact that both components are vectorially oppose, each force $F_V$ in any support point 6–7 would be equal to zero because $r = I/m \cdot Z$.

In a second embodiment, the distance r is chosen in such a way that a compromise value is achieved according to the desired result between the values of the vertically directed forces $F_V$ and the horizontally directed forces $F_h$.

Quite obviously, any specialist of this technique would be above to determine the distance r according to the desired result, by means of calculation following the principles disclosed above or by carrying out comparative tests with several battens.

In another embodiment, and in order to limit the horizontally directed force $F_h$, one strives, besides the characteristics already reported, to design also the batten involved in such a way that the inertia moment I becomes minimum in relation to the axis of gravity Z—Z.

The resulting advantage of this solution is the following. For any specific loom, the batten is designed on the basis of some parameters which are already well known, some of them being constant while the other ones are considered as being constant. If the most typical model of FIG. 3 already discussed is taken into consideration, it is also possible to consider that the values of the distance L and of the angular acceleration $\alpha$ are constant parameters. The value of Z causes only small differences for whichever design and may be considered as constant by way of approximation.

In the preferred form of the invention according to the model of FIG. 3, the absolute values of the components $L \cdot \alpha / L$ and $m \cdot r \cdot \alpha \cdot Z / L$ are necessarily equal to each other. It must thus be concluded that the value of the product $m \cdot r \cdot \alpha$, i.e. the magnitude of the horizontally directed forces $F_h$, is determined by the quotient of I/Z or that, in the case the value of Z is considered as constant, the force $F_h$ is proportional with the inertial mement I.

The discussion here makes evident that this form of the batten is designed in order to reduce to a minimum the inertia moment I, in order to keep to a minimum the horizontally directed force $F_h$.

Figure 5:
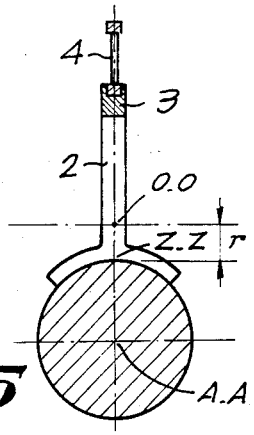
FIG. 5 shows a cross section taken along line V—V of FIG. 4.

In the form of the invention which is illustrated by FIGS. 4 and 5, the batten axis 1 is designed in such a way that the inertia moment I of the whole batten is minimum in relation to the axis of gravity Z—Z. To this end, the outside surface of the solid cylindrical batten shaft 1 is limited at the axis of gravity Z—Z. The reported characteristics whereby the axis of gravity Z—Z is located between the swinging axis 0—0 of the batten and the central axis A—A of the batten shaft A is obviously kept without any modification.

The latter form of the invention has been carried out with a mass m of 112 kg whereby the axis of gravity Z—Z is located at a distance (r) of 0.0079 meter from the swinging axis 0—0. The values of L and Z are respectively 1 meter and 0.844 meter. The order of magnitude of the angular accelaration $\alpha$ amounts to 1800 rad/s2 at a rotational speed of the loom equal to 475 revolutions per minute. The inertia moment of this example of the invention is 0.75 kg $m^2$. The forces $I \cdot \alpha / L$ and $m \cdot r \cdot \alpha \cdot Z/L$ cancel themselves mutually and have a value of 1350 Newton each at the rotational speed considered.

The invention is by no means limited to the herein described examples or to emobidiments which are illustrated by the drawing, since a batten of this kind can be realised with various shapes and sizes while still embodying the invention.

What is claimed is:

1. A batten assembly for a weaving loom comprising a batten shaft and a reed assembly supported by supports on one side of the batten shaft; the batten assembly having a swinging axis and the batten shaft having a central axis located to one side of and extending parallel to the swinging axis; the batten assembly center or axis of gravity and the batten assembly swinging axis being located away from the batten shaft central axis but within the transverse cross sectional periphery of the batten shaft.

2. A batten assembly according to claim 1, wherein the swinging axis is located on the transverse cross sectional periphery of the batten shaft.

3. A batten assembly according to claim 1, wherein the batten center or axis of gravity is located between the swinging axis of the batten assembly and the batten shaft central axis.

4. A batten assembly according to claim 3 wherein the swinging axis is located on the transverse cross sectional periphery of the batten shaft.

5. A batten assembly according to claim 1, wherein the batten shaft is massive and circular in transverse cross section.

6. A batten assembly for a weaving loom comprising a batten shaft and a reed assembly supported by supports on one side of the batten shaft; the batten assembly having a swinging axis and the batten shaft having a central axis located to one side of an extending parallel to the swinging axis; the swinging axis located away from the center or axis of gravity of the batten assembly and outside the batten shaft cross sectional periphery, with the axis or center of gravity of the batten assembly being located within the shaft transverse cross sectional periphery.

7. A batten assembly according to claim 6, wherein the center or axis of gravity is located between the swinging axis of the batten assembly and the central axis of the batten shaft.

8. A batten assembly according to claim 6, wherein the center or axis of gravity is located on the outer periphery of the batten shaft.

9. In a weaving loom including a batten assembly including a batten shaft having a central longitudinal axis on one side of which is supported by support means a reed assembly, said batten assembly being supported on the loom by bearings for swinging motion about a swinging axis extending parallel to the batten shaft central axis; the improvement comprising:

said batten assembly center or axis of gravity being located within the transverse cross sectional periphery of the batten shaft;

the location of the center or axis of gravity of the batten assembly, the shaft central axis and the shaft swinging axis being arranged so that when the center or axis of gravity of the batten assembly, the shaft central axis and the shaft swinging axis are located in a single vertical plane, the moment resulting from the rotational acceleration of the batten assembly relative to the batten's swinging axis is such that the moment resulting from the rotational acceleration opposes and cancels the moment of the force resulting from the horizontally directed component of the translational acceleration of the batten assembly.

* * * * *